US008486270B2

(12) United States Patent
Rieger et al.

(10) Patent No.: US 8,486,270 B2
(45) Date of Patent: Jul. 16, 2013

(54) METHOD OF INCREASING THE EFFICIENCY IN AN ORE SEPARATION PROCESS BY MEANS OF HYDROPHOBIC MAGNETIC PARTICLES BY TARGETED INPUT OF MECHANICAL ENERGY

(75) Inventors: Reinhold Rieger, Offstein (DE); Alexej Michailovski, Ludwigshafen (DE); Imme Domke, Mannheim (DE)

(73) Assignees: BASF SE, Ludwigshafen (DE); Siemens Aktiengesellschaft, Munich (DE)

( * ) Notice: Subject to any disclaimer, the term of this patent is extended or adjusted under 35 U.S.C. 154(b) by 0 days.

(21) Appl. No.: 13/509,413

(22) PCT Filed: Nov. 10, 2010

(86) PCT No.: PCT/EP2010/067179

§ 371 (c)(1),
(2), (4) Date: May 11, 2012

(87) PCT Pub. No.: WO2011/058039

PCT Pub. Date: May 19, 2011

(65) Prior Publication Data

US 2012/0228413 A1 Sep. 13, 2012

(30) Foreign Application Priority Data

Nov. 11, 2009 (EP) ..... 0917563

(51) Int. Cl.
*B02C 23/18* (2006.01)
*B03C 1/01* (2006.01)
*G03C 1/32* (2006.01)

(52) U.S. Cl.
USPC ..... 210/679; 210/695; 210/714; 209/5; 209/8; 209/9; 209/39; 209/214

(58) Field of Classification Search
USPC ..... 210/679, 695, 714; 209/5, 8, 9, 39, 209/214
See application file for complete search history.

(56) References Cited

U.S. PATENT DOCUMENTS

| | | | |
|---|---|---|---|
| 3,301,691 | A | 1/1967 | Hemstock et al. |
| 3,817,457 | A | 6/1974 | Clark |
| 4,045,235 | A | 8/1977 | Bidwell et al. |
| 4,281,799 | A | 8/1981 | Oder |
| 4,643,822 | A | 2/1987 | Parsonage |
| 4,657,666 | A | 4/1987 | Snook et al. |
| 4,834,898 | A | 5/1989 | Hwang |
| 5,593,490 | A | 1/1997 | Etheridge et al. |
| 6,866,838 | B1 | 3/2005 | Mondain-Monval et al. |
| 2003/0085012 | A1 | 5/2003 | Jones et al. |
| 2005/0178292 | A1 | 8/2005 | Jones et al. |
| 2005/0247418 | A1 | 11/2005 | Jones et al. |
| 2006/0009566 | A1 | 1/2006 | Jones et al. |
| 2010/0300941 | A1 | 12/2010 | Domke et al. |
| 2010/0307982 | A1 | 12/2010 | Domke et al. |
| 2011/0303772 | A1 | 12/2011 | Michailovski et al. |

FOREIGN PATENT DOCUMENTS

| | | |
|---|---|---|
| WO | 84 00703 | 3/1984 |
| WO | 02 066168 | 8/2002 |
| WO | 2007 008322 | 1/2007 |
| WO | 2009 030669 | 3/2009 |
| WO | 2009 065802 | 5/2009 |

OTHER PUBLICATIONS

Translation of the International Preliminary Report on Patentability for PCT/EP2010/067179, undated.*
Gray, S. R. et al., "Recovery of Fine Gold Particles by Flocculation with Hydrophobic Magnetite", Extractive Metallurgy Conference, pp. 223-226, (Oct. 2-4, 1991).
International Search Report Issued Jan. 21, 2011 in PCT/EP10/067179 filed Nov. 10, 2010.
U.S. Appl. No. 13/504,519, filed Apr. 27, 2012, Rieger, et al.
U.S. Appl. No. 13/434,176, filed Mar. 29, 2012, Deuerlein, et al.

* cited by examiner

*Primary Examiner* — David A Reifsnyder
(74) *Attorney, Agent, or Firm* — Oblon, Spivak, McClelland, Maier & Neustadt, L.L.P.

(57) ABSTRACT

The present invention relates to a process for separating at least one first material from a mixture comprising this at least one first material and at least one second material, which comprises the following steps (A) contacting of the mixture comprising at least one first material and at least one second material with at least one magnetic particle in the presence of at least one dispersion medium so that the at least one first material and the at least one magnetic particle agglomerate, (B) if appropriate, addition of further dispersion medium to the dispersion obtained in step (A), (C) separation of the agglomerate from step (A) or (B) from the mixture by application of a magnetic field, (D) and dissociation of the agglomerate separated off in step (C) in order to obtain the at least one first material and the at least one magnetic particle separately, with an energy input of at least 10 kW/m$^3$ being introduced into the dispersion in step (A).

19 Claims, No Drawings

METHOD OF INCREASING THE EFFICIENCY IN AN ORE SEPARATION PROCESS BY MEANS OF HYDROPHOBIC MAGNETIC PARTICLES BY TARGETED INPUT OF MECHANICAL ENERGY

The present invention relates to a process for separating at least one first material from a mixture comprising this at least one first material and at least one second material, which comprises the following steps (A) contacting of the mixture comprising at least one first material and at least one second material with at least one magnetic particle in the presence of at least one dispersion medium so that the at least one first material and the at least one magnetic particle agglomerate, (B) if appropriate, addition of further dispersion medium to the dispersion obtained in step (A), (C) separation of the agglomerate from step (A) or (B) from the mixture by application of a magnetic field, (D) dissociation of the agglomerate separated off in step (C) in order to obtain the at least one first material and the at least one magnetic particle separately, with an energy input of at least 10 kW/m$^3$ being introduced into the dispersion in step (A).

In particular, the present invention provides a process for the enrichment of ores in the presence of the gangue.

Processes for separating ores from mixtures comprising these are already known from the prior art.

WO 02/0066168 A1 relates to a process for separating ores from mixtures comprising these, in which suspensions or slurries of these mixtures are treated with particles which are magnetic and/or can float in aqueous solutions. After addition of the magnetic and/or floatable particles, a magnetic field is applied so that the agglomerates are separated off from the mixture. However, the degree of attachment of the magnetic particles to the ores and the strength of the bond are not sufficient to carry out the process with a sufficiently high yield and effectiveness.

U.S. Pat. No. 4,657,666 discloses a process for the enrichment of ores, in which the ore present in the gangue is reacted with magnetic particles, resulting in formation of agglomerates due to the hydrophobic interactions. The magnetic particles are hydrophobicized on the surface by treatment with hydrophobic compounds so that attachment to the ore occurs. The agglomerates are then separated off from the mixture by means of a magnetic field. The cited document also discloses that the ores are treated with a surface-activating solution of 1% of sodium ethylxanthogenate before the magnetic particle is added. In this process, separation of ore and magnetic particle is effected by destruction of the surface-activating substance which has been applied in the form of the surface-activating solution to the ore. Furthermore, only $C_4$ hydrophobicizing agents for the ore are used in this process.

U.S. Pat. No. 4,834,898 discloses a process for separating off nonmagnetic materials by bringing them into contact with magnetic reagents which are enveloped in two layers of surface-active substances. U.S. Pat. No. 4,834,898 further discloses that the surface charge of the nonmagnetic particles which are to be separated off can be influenced by various types and concentrations of electrolyte reagents. For example, the surface charge is altered by addition of multivalent anions, for example tripolyphosphate ions.

S. R. Gray, D. Landberg, N. B. Gray, Extractive Metallurgy Conference, Perth, 2-4 Oct. 1991, pages 223-226, discloses a process for recovering small gold particles by bringing the particles into contact with magnetite. Before the contacting, the gold particles are treated with potassium amylxanthogenate. A process for separating off the gold particles from at least one hydrophilic material is not disclosed in this document.

WO 2007/008322 A1 discloses a magnetic particle which is hydrophobicized on the surface for the separation of impurities from mineral substances by magnetic separation processes. According to WO 2007/008322 A1, a dispersant selected from among sodium silicate, sodium polyacrylate and sodium hexametaphosphate can be added to the solution or dispersion.

WO 2009/030669 A2 discloses a process for separating ores from mixtures of these with the gangue by means of magnetic particles, in which the ore is firstly hydrophobicized by means of a suitable substance so that the hydrophobicized ore and the magnetic particle agglomerate and can separated off. WO 2009/065802 A2 discloses a similar process for separating an ore from the gangue by means of magnetic particles, with the agglomeration of magnetic particles and ore being based on different surface charges. Both processes are in need of improvement in respect of their efficiency.

It is an object of the present invention to provide a process by means of which at least one first material can be separated off efficiently from mixtures comprising at least one first material and at least one second material. Furthermore, it is an object of the present invention to treat the first particles to be separated off in such a way that the agglomerate of magnetic particle and first material is sufficiently stable to ensure a high yield of the first material in the separation. A further object of the present invention is to provide a process of this type in which the formation of the agglomerates is improved by means of suitable measures. Furthermore, only a very small proportion of the at least one second material, in particular the gangue, should be included in these agglomerates in order to increase, for example, the space-time yield of a work-up following the process of the invention.

These objects are achieved by a process for separating at least one first material from a mixture comprising this at least one first material and at least one second material, which comprises the following steps:

(A) contacting of the mixture comprising at least one first material and at least one second material with at least one magnetic particle in the presence of at least one dispersion medium so that the at least one first material and the at least one magnetic particle agglomerate, (B) if appropriate, addition of further dispersion medium to the dispersion obtained in step (A), (C) separation of the agglomerate from step (A) or (B) from the mixture by application of a magnetic field and (D) dissociation of the agglomerate separated off in step (C) in order to obtain the at least one first material and the at least one magnetic particle separately, with an energy input of at least 10 kW/m$^3$ being introduced into the dispersion in step (A).

In a preferred embodiment of the process of the invention, the first material is a hydrophobic metal compound or coal and the second material is a hydrophilic metal compound.

In a further preferred embodiment of the process of the invention, the at least one hydrophobic metal compound is selected from the group consisting of sulfidic ores, oxidic and/or carbonate-comprising ores.

In a further preferred embodiment of the process of the invention, the at least one hydrophilic metal compound is selected from the group consisting of oxidic and hydroxidic compounds.

The at least one first material to be separated off is preferably a metal compound selected from the group consisting of sulfidic ores, oxidic and/or carbonate-comprising ores, for example azurite [$Cu_3(CO_3)_2(OH)_2$] or malachite [$Cu_2[(OH)_2|CO_3]$], or noble metals to which a surface-active compound can bind selectively to produce hydrophobic surface properties.

Examples of sulfidic ores which can be used according to the invention are, for example, selected from the group of copper ores consisting of covellite CuS, chalcopyrite (copper pyrite) $CuFeS_2$, bornite $Cu_5FeS_4$, chalcocite (copper glance) $Cu_2S$ and mixtures thereof and also other sulfides such as molybdenum(IV) sulfide and pentlandite ($NiFeS_2$).

The at least one second material is preferably selected from the group consisting of oxidic and hydroxidic compounds, for example silicon dioxide $SiO_2$, silicates, aluminosilicates, for example feldspars, for example albite $Na(Si_3Al)O_8$, mica, for example muscovite $KAl_2[(OH,F)_2AlSi_3O_{10}]$, garnets $(Mg,Ca,Fe^{II})_3(Al,Fe^{III})_2(SiO_4)_3$, $Al_2O_3$, FeO(OH), $FeCO_3$ and further related minerals and mixtures thereof.

Accordingly, the process of the invention is preferably carried out using untreated ore mixtures which are obtained from mine deposits.

In a preferred embodiment of the process of the invention, the mixture comprising at least one first material and at least one second material is present in the form of particles having a size of from 100 nm to 100 μm in step (A), see, for example, U.S. Pat. No. 5,051,199. In a preferred embodiment, this particle size is obtained by milling. Suitable processes and apparatuses are known to those skilled in the art, for example wet milling in a ball mill. In a preferred embodiment of the process of the invention, the mixture comprising at least one first material and at least one second material is thus milled to particles having a size of from 100 nm to 100 μm before or during step (A). Ore mixtures which can preferably be used have a content of sulfidic minerals of at least 0.01% by weight, preferably at least 0.5% by weight, particularly preferably at least 3% by weight.

Examples of sulfidic minerals present in the mixtures which can be used according to the invention are those mentioned above. In addition, sulfides of metals other than copper, for example sulfides of iron, lead, zinc or molybdenum, i.e. $FeS/FeS_2$, PbS, ZnS or $MoS_2$, can also be present in the mixtures. Furthermore, oxidic compounds of metals and semimetals, for example silicates or borates or other salts of metals and semimetals, for example phosphates, sulfates or oxides/hydroxides/carbonates and further salts, for example azurite [$Cu_3(CO_3)_2(OH)_2$], malachite [$Cu_2[(OH)_2(CO_3)]$], barite ($BaSO_4$), monazite ($(La—Lu)PO_4$), can be present in the ore mixtures to be treated according to the invention. Further examples of the at least one first material which is separated off by means of the process of the invention are noble metals, for example Au, Pt, Pd, Rh etc., which can preferably be present in the native state, as alloy or in associated form.

An ore mixture which is typically used and can be separated by the process of the invention has the following composition: about 30% by weight of $SiO_2$, about 10% by weight of $Na(Si_3Al)O_8$, about 3% by weight of $Cu_2S$, about 1% by weight of $MoS_2$, balance chromium, iron, titanium and magnesium oxides.

As magnetic particles, it is generally possible to use all magnetic particles known to those skilled in the art which satisfy the requirements of the process of the invention, for example suspendability in any suspension medium used and the ability to be functionalized by the at least one polymeric compound.

Furthermore, the magnetic particle should have a sufficiently high saturation magnetizability, for example 25-300 emu/g, and a low remanence so that the adduct can be separated off in a sufficient amount from the suspension in step (C) of the process of the invention.

In a preferred embodiment, the at least one magnetic particle is selected from the group consisting of magnetic metals, for example iron, cobalt, nickel and mixtures thereof, ferromagnetic alloys of magnetic metals, magnetic iron oxides, for example magnetite, maghemite, cubic ferrites of the general formula (II)

$$M^{2+}{}_xFe^{2+}{}_{1-x}Fe^{3+}{}_2O_4 \quad \text{(II)}$$

where

M is selected from among Co, Ni, Mn, Zn and mixtures thereof and $x \leqq 1$, hexagonal ferrites, for example barium or strontium ferrite $MFe_{12}O_{19}$ where M=Ca, Sr, Ba, and mixtures thereof.

In a particularly preferred embodiment of the present patent application, the at least one magnetic particle is magnetite $Fe_3O_4$ or cobalt ferrite $Co^{2+}{}_xFe^{2+}{}_{1-x}Fe^{3+}{}_2O_4$ where $x \leqq 1$, for example $Co_{0.25}Fe_{2.75}O_4$.

The size of the magnetic particles used according to the invention is preferably from 10 nm to 10 μm.

The magnetic particles which can be used according to the invention can optionally be hydrophobicized on the surface, for example by means of at least one hydrophobic compound selected from among compounds of the general formula (V)

$$B—Y \quad \text{(V)},$$

where

B is selected from among linear or branched $C_3$-$C_{30}$-alkyl, $C_3$-$C_{30}$-heteroalkyl, optionally substituted $C_6$-$C_{30}$-aryl, optionally substituted $C_6$-$C_{30}$-heteroalkyl, $C_6$-$C_{30}$-aralkyl and Y is a group by means of which the compound of the general formula (V) binds to the at least one magnetic particle.

In a particularly preferred embodiment, B is a linear or branched $C_6$-$C_{18}$-alkyl, preferably linear $C_8$-$C_{12}$-alkyl, very particularly preferably a linear $C_{12}$-alkyl. Heteroatoms which may be present according to the invention are selected from among N, O, P, S and halogens such as F, Cl, Br and I.

In a further particularly preferred embodiment, Y is selected from the group consisting of $—(X)_n—SiHal_3$, $—(X)_n—SiHHal_2$, $—(X)_n—SiH_2Hal$ where Hal is F, Cl, Br, I, and anionic groups such as $—(X)_n—SiO_3^{3-}$, $—(X)_n—CO_2^-$, $—(X)_n—PO_3^{2-}$, $—(X)_n—PO_2S^{2-}$, $—(X)_n—POS_2^{2-}$, $—(X)_n—PS_3^{2-}$, $—(X)_n—PS_2^-$, $—(X)_n—POS^-$, $—(X)_n—PO_2^-$, $—(X)_n—CO_2^-$, $—(X)_n—CS_2^-$, $—(X)_n—COS^-$, $—(X)_n—C(S)NHOH$, $—(X)_n—S^-$ where X=O, S, NH, $CH_2$ and n=0, 1 or 2, and, if appropriate, cations selected from the group consisting of hydrogen, $NR_4^+$ where the radicals R are each, independently of one another, hydrogen or $C_1$-$C_8$-alkyl, an alkaline earth metal or zinc, also $—(X)_n—Si(OZ)_3$ where n=0, 1 or 2 and Z=charge, hydrogen or short-chain alkyl radical.

If n=2 in the formulae mentioned, two identical or different, preferably identical, groups B are bound to a group Y.

Very particularly preferred hydrophobicizing substances of the general formula (V) are alkyltrichlorosilanes (alkyl group having 6-12 carbon atoms), alkyltrimethoxysilanes (alkyl group having 6-12 carbon atoms), octylphosphonic acid, lauric acid, oleic acid, stearic acid or mixtures thereof.

The individual steps of the process of the invention are described in detail below:

Step (A):

Step (A) of the process of the invention comprises contacting of the mixture comprising at least one first material and at least one second material with at least one magnetic particle in the presence of at least one dispersion medium so that the at least one first material and the at least one magnetic particle agglomerate.

Suitable and preferred first and second materials have been mentioned above.

According to the invention, the at least one first material to be separated off and the at least one magnetic particle agglomerate in step (A) of the process of the invention. The agglomeration can generally occur as a result of all attractive forces known to those skilled in the art between the at least one first material and the at least one magnetic particle. According to the invention, essentially only the at least one first material and the at least one magnetic particle agglomerate in step (A) of the process of the invention while the at least one second material and the at least one magnetic particle essentially do not agglomerate.

In a preferred embodiment of the process of the invention, the at least one first material and the at least one magnetic particle agglomerate as a result of hydrophobic interactions, different surface charges and/or compounds present in the mixture which selectively couple the at least one first material and the at least one magnetic particle.

The abovementioned alternatives for agglomeration of the at least one first material and the at least one magnetic particle are explained below.

In a first preferred embodiment of step (A) of the process of the invention, the at least one first material and the at least one magnetic particle agglomerate as a result of hydrophobic interactions.

For the purposes of the present invention, "hydrophobic" means that the corresponding particles can be subsequently hydrophobicized by treatment with the at least one surface-active substance. It is also possible for an intrinsically hydrophobic particle to be additionally hydrophobicized by treatment with the at least one surface-active substance.

"Hydrophobic" means, for the purposes of the present invention, that the surface of a corresponding "hydrophobic substance" or a "hydrophobicized substance" has a contact angle of >90° with water against air. "Hydrophilic" means, for the purposes of the present invention, that the surface of a corresponding "hydrophilic substance" has a contact angle of <90° with water against air.

The contacting in step (A) of the process of the invention can occur by all methods known to those skilled in the art. Step (A) is carried out in dispersion, preferably in suspension, particularly preferably in aqueous suspension.

As dispersion media, it is in general possible to use all dispersion media in which the mixture of step (A) is not completely soluble. Suitable dispersion media are, for example, selected from the group consisting of water, water-soluble organic compounds, for example alcohols having from 1 to 4 carbon atoms, and mixtures thereof. In a particularly preferred embodiment, the dispersion medium is water.

Step (A) of the process of the invention is generally carried out at a temperature of from 1 to 80° C., preferably from 20 to 40° C., particularly preferably at ambient temperature.

EMBODIMENT A1

In this preferred embodiment A1 of the process of the invention, step (A) is carried out by firstly bringing the at least one first material comprised in the mixture into contact with a surface-active substance in order to hydrophobicize the at least one first material, then bringing this mixture into contact with at least one magnetic particle so that the at least one magnetic particle and the at least one first material which has been hydrophobicized on the surface agglomerate.

For the purposes of the present invention, "surface-active substance" means a substance which is able to alter the surface of the particle to be separated off in the presence of other particles which are not to be separated off in such a way that attachment of a hydrophobic particle occurs as a result of hydrophobic interactions.

Surface-active substances which can be used according to the invention selectively bind to the at least one first material and thereby make the first material suitably hydrophobic. "Selectively" means, for the purposes of the present invention, that the partition coefficient of the surface-active substance between the surface of the at least one first material and the surface of the at least one second material is generally >1, preferably >100, particularly preferably >10 000, i.e. the surface-active substance preferentially binds to the surface of the at least one first material and not to the surface of the at least one second material.

The process of the invention is preferably carried out using a surface-active substance of the general formula (I)

$$A\text{-}Z \qquad (I)$$

which binds to the at least one first material, where

A is selected from among linear or branched $C_3$-$C_{30}$-alkyl, $C_3$-$C_{30}$-heteroalkyl, optionally substituted $C_6$-$C_{30}$-aryl, optionally substituted $C_6$-$C_{30}$-heteroalkyl, $C_6$-$C_{30}$-aralkyl and Z is a group by means of which the compound of the general formula (I) binds to the at least one hydrophobic material.

In a particularly preferred embodiment, A is a linear or branched $C_4$-$C_{12}$-alkyl, very particularly preferably a linear $C_4$- or $C_8$-alkyl. Heteroatoms which may be present according to the invention are selected from among N, O, P, S and halogens such as F, Cl, Br and I.

In a further preferred embodiment, A is preferably a linear or branched, preferably linear, $C_6$-$C_{20}$-alkyl. Furthermore, A is preferably a branched $C_6$-$C_{14}$-alkyl in which the at least one substituent, preferably having from 1 to 6 carbon atoms, is preferably present in the 2 position, for example 2-ethylhexyl and/or 2-propylheptyl.

In a further particularly preferred embodiment, Z is selected from the group consisting of anionic groups $—(X)_n—PO_3^{2-}$, $—(X)_n—PO_2S^{2-}$, $—(X)_n—POS_2^{2-}$, $—(X)_n—PS_3^{2-}$, $—(X)_n—PS_2^-$, $—(X)_n—POS^-$, $—(X)_n—PO_2^-$, $—(X)_n—PO_3^{2-}—(X)_n—CO_2^-$, $—(X)_n—CS_2^-$, $—(X)_n—COS^-$, $—(X)_n—C(S)NHOH$, $—(X)_n—S^-$ where X is selected from the group consisting of O, S, NH, $CH_2$ and n=0, 1 or 2, if appropriate with cations selected from the group consisting of hydrogen, $NR_4^+$ where the radicals R are each, independently of one another, hydrogen or $C_1$-$C_8$-alkyl, an alkali metal or alkaline earth metal. The anions mentioned and the corresponding cations form, according to the invention, uncharged compounds of the general formula (I).

If n=2 in the formulae mentioned, then two identical or different, preferably identical, groups A are bound to a group Z.

In a particularly preferred embodiment, use is made of compounds selected from the group consisting of xanthates $A\text{-}O—CS_2^-$, dialkyldithiophosphates $(A\text{-}O)_2—PS_2^-$, dialkyldithiophosphinates $(A)_2\text{-}PS_2^-$ and mixtures thereof, where the radicals A are each, independently of one another, a linear or branched, preferably linear, $C_6$-$C_{20}$-alkyl, preferably n-octyl, or a branched $C_6$-$C_{14}$-alkyl in which the branch is preferably present in the 2 position, for example 2-ethylhexyl and/or 2-propylheptyl. Counterions present in these compounds are preferably cations selected from the group consisting of hydrogen, $NR_4^+$ where the radicals R are each, independently of one another, hydrogen or $C_1$-$C_8$-alkyl, an alkali or alkaline earth metal, in particular sodium or potassium.

Very particularly preferred compounds of the general formula (I) are selected from the group consisting of sodium or potassium n-octylxanthate, sodium or potassium butylxanthate, sodium or potassium di-n-octyldithiophosphinate, sodium or potassium di-n-octyldithiophosphate and mixtures of these compounds.

In the case of noble metals, for example Au, Pd, Rh etc., particularly preferred surface-active substances are monothiols, dithiols and trithiols or 8-hydroxyquinolines, for example as described in EP 1200408 B1.

In the case of metal oxides, for example FeO(OH), $Fe_3O_4$, ZnO etc., carbonates, for example azurite $[Cu(CO_3)_2(OH)_2]$, malachite $[Cu_2[(OH)_2CO_3]]$, particularly preferred surface-active substances are octylphosphonic acid (OPA), $(EtO)_3Si$-A, $(MeO)_3Si$-A, with the abovementioned meanings for A. In a preferred embodiment of the process of the invention, no hydroxamates are used as surface-active substances for modifying metal oxides.

In the case of metal sulfides, for example $Cu_2S$, $MoS_2$, etc., particularly preferred surface-active substances are monothiols, dithiols and trithiols or xanthogenates.

In a further preferred embodiment of the process of the invention, Z is $—(X)_n—CS_2^-$, $—(X)_n—PO_2^-$ or $—(X)_n—S^-$ where X is O and n is 0 or 1 and a cation selected from among hydrogen, sodium and potassium. Very particularly preferred surface-active substances are 1-octanethiol, potassium n-octylxanthate, potassium butylxanthate, octylphosphonic acid or a compound of the formula (IV)

(IV)

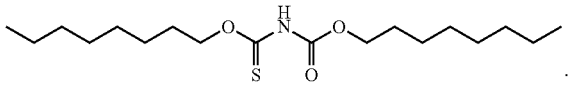

The at least one surface-active substance is generally used in an amount which is sufficient to achieve the desired effect. In a preferred embodiment, the at least one surface-active substance is added in an amount of from 0.01 to 5% by weight, in each case based on the total mixture to be treated.

Further details of this embodiment are disclosed in WO 2009/030669 A2.

Embodiment A2

In this further embodiment A2 of step (A) of the process of the invention, the mixture to be treated is firstly brought into contact with at least one hydrocarbon in an amount of from 0.01 to 0.4% by weight, based on the sum of the mixture to be treated and the at least one hydrocarbon, and this mixture is then brought into contact with the at least one magnetic particle. Embodiment A2 is particularly advantageous when not only the at least one first material and at least one second material but also at least one third material are present. The at least one third material is preferably selected from the group which has been mentioned above for the at least one second material, with at least one second material and at least one third material being different.

For the purposes of the present invention, a hydrocarbon is an organic chemical compound which is made up essentially of carbon, hydrogen and optionally oxygen. If oxygen is present in addition to carbon and hydrogen in the hydrocarbons which can be used according to the invention, it is present in the form of, for example, ester, carboxyl and/or ether groups. In step (A) according to embodiment A2 of the process of the invention, it is possible to use either an essentially uniform hydrocarbon or a hydrocarbon mixture.

Hydrocarbons or hydrocarbon mixtures which can be used according to the invention generally have a low viscosity under the conditions of the process of the invention, so that they are liquid and mobile under the process conditions according to the invention. Preference is given to using hydrocarbons or hydrocarbon mixtures which have a viscosity of from 0.1 to 100 cP, preferably from 0.5 to 5 cP, in each case at 20° C.

Hydrocarbons or hydrocarbon mixtures which can be used according to the invention generally have a flash point of ≧20° C., preferably ≧40° C. The present invention therefore also provides the process according to the invention in which the at least one hydrocarbon has a flash point of ≧20° C., particularly preferably ≧40° C.

In a preferred embodiment of the process of the invention, the at least one hydrocarbon is selected from the group consisting of mineral oils, vegetable oils, biodiesel, BtL (biomass-to-liquid) fuels, products of coal liquefaction, products of the GtL (gas-to-liquid, from natural gas) process and mixtures thereof.

Mineral oils are, for example, crude oil derivatives and/or oils produced from brown coal, hard coal, turf, wood, crude oil and if appropriate also other mineral raw materials by distillation. Mineral oils generally comprise hydrocarbon mixtures of paraffinic hydrocarbons, i.e. saturated chain-like hydrocarbons, naphthenic hydrocarbons, i.e. saturated cyclic hydrocarbons, and aromatic hydrocarbons.

A particularly preferred crude oil derivative is diesel or gas oil. Diesel generally has a composition known to those skilled in the art. Diesel is based essentially on mineral oil, i.e. diesel is a fraction obtained in the separation of mineral oil by distillation. The main constituents of diesel are alkanes, cycloalkanes and aromatic hydrocarbons having from about 9 to 22 carbon atoms per molecule and a boiling range from 170° C. to 390° C.

Further terms used for suitable petroleum derivatives comprise: light gas oil (boiling point 235-300° C., depending on the spec. also known as "diesel", "diesel fuel", "DF", "light heating oil" "HEL"), heavy gas oil (boiling point 300-375° C.) and also (in the USA) "No. 2 fuel".

Vegetable oils are generally the fats and fatty oils obtained from oil plants. Vegetable oils comprise, for example, triglycerides. Vegetable oils which are suitable for the purposes of the invention are, for example, selected from the group consisting of sunflower oil, rapeseed oil, safflower oil, soybean oil, maize germ oil, peanut oil, olive oil, herring oil, cottonseed oil, palm oil and mixtures thereof.

Biodiesel generally has a composition known to those skilled in the art. Biodiesel comprises essentially methyl esters of saturated $C_{16}$-$C_{18}$ fatty acids and unsaturated $C_{18}$ fatty acids, in particular the methyl ester of rapeseed oil.

Products of coal liquefaction can be obtained, for example, by the Fischer-Tropsch or Sasol process. The BtL and GtL processes are known to those skilled in the art.

In a preferred embodiment of the process of the invention, diesel, kerosene and/or light gas oil are used as hydrocarbon in step (A). On the laboratory scale, diesel of the brands Solvesso® and/or Shellsol® can advantageously be used.

If appropriate, at least one hydrophobicizing agent can additionally be added in step (A) according to embodiment A2 of the process of the invention. Suitable hydrophobicizing agents are the abovementioned compounds of the general formula (I).

Embodiment A3

In this further preferred embodiment A3 of step (A) of the process of the invention, the at least one magnetic particle is brought into contact with at least one bifunctional molecule of the general formula (VI)

$$(F^1)_x\text{-}(A)_n\text{-}(F^2)_y \quad \text{(VI)},$$

where $F^1$ is a functional group which binds selectively to the at least one magnetic particle, $F^2$ is a functional group which binds selectively to the at least one first material, A is a structural unit selected from among $CRH_2$ groups where R is selected from among hydrogen and a linear or branched carbon radical having from 1 to 30 carbon atoms, an aromatic or heteroaromatic unit, a cyclic or heterocyclic unit, an unsaturated, branched or unbranched carbon chain having from 2 to 30 carbon atoms, a heteroatom and combinations of the above-mentioned structural units, n is an integer from 1 to 100 x is an integer from 1 to 4 and y is an integer from 1 to 4, or an adduct of the two is brought into contact with the mixture comprising the at least one first material and at least one second material, so that an adduct of the at least one magnetic particle, the bifunctional compound of the general formula (VI) and the at least one first material is formed.

$F^1$ and $F^2$ are in each case functional groups which bind selectively to the at least one magnetic particle ($F^1$) or to the at least one first material ($F^2$).

For the purposes of the present invention, "selectively" means that the respective functional group $F^1$ or $F^2$ binds to an extent of from 50 to 95%, preferably from 70 to 98%, particularly preferably from 80 to 98%, based on $F^1$, to the at least one magnetic particle or, based on $F^2$, to the at least one first material, in each case in the presence of the at least one second material, in each case based on all bonds between functional groups and components present in the mixture.

In a preferred embodiment, $F^1$ is a functional group which in the presence of silicates binds selectively to the at least one magnetic particle, particularly preferably a functional group selected from among the phosphonic acid group —$OP(OH)_2$ and the carboxyl group —COOH.

In a further preferred embodiment, $F^2$ is a functional group which binds to the at least one first material in the presence of oxidic ores, for example the abovementioned ores, in particular $SiO_2$ or albite, particularly preferably a functional group selected from the group consisting of the thiol group —SH, the hydroxy group —OH, xanthogenate —OCSSH, thiolate —$S^-$, the dihydroxy group, for example the 1,2-dihydroxy or 1,3-dihydroxy group, a dithiol group, for example a 1,2-dithiol or 1,3-dithiol group, a thiohydroxy group, for example a 1,2-thiohydroxy or 1,3-thiohydroxy group, functional groups of the general formula (III) and mixtures thereof.

(III)

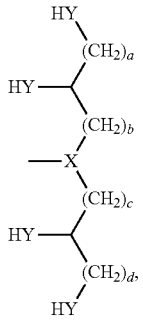

where the radicals Y are each, independently of one another, S, NH, O, preferably independently of one another S or O, X is N, P, $CH_2$, preferably N, a, b, c, d are each, independently of one another, an integer from 1 to 6, preferably 1 or 2.

Functional groups $F^2$ of the general formula (III) are bound to $\text{-}(A)_n\text{-}$ via the free bond on X.

Very particularly preferred functional groups $F^2$ of the general formula (III) are selected from the group of compounds of the formulae (IIIa), (IIIb), (IIIc), (IIId) and (IIIe):

(IIIa)

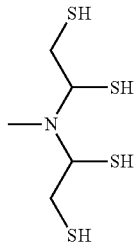

(IIIb)

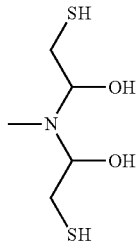

(IIIc)

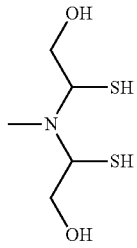

-continued (IIId)

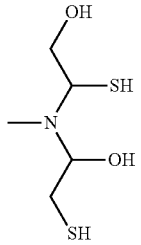

(IIIe)

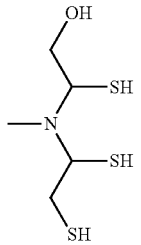

In the general formula (VI), A is a structural unit selected from among $CRH_2$ groups where R is selected from among hydrogen and a linear or branched carbon radical having from 1 to 30 carbon atoms, an aromatic or heteroaromatic unit, a cyclic or heterocyclic unit, an unsaturated, branched or unbranched carbon chain having from 2 to 30 carbon atoms, a heteroatom and combinations of the abovementioned structural units, preferably a $CH_2$ group, with it also being possible according to the invention for C—C— double and/or triple bonds to be present in the skeleton of the bifunctional compounds formed by $-(A)_n-$. Heteroatoms are, for example, O, S, N and/or P. Suitable aromatic or heteroaromatic units are, for example, selected from among substituted or unsubstituted aromatic or heteroaromatic units having from 6 to 20 carbon atoms and if appropriate heteroatoms, for example phenyl, benzyl and/or naphthyl. The aromatic units can be incorporated into the chain via the 1,2, 1,3 and/or 1,4 positions.

In the compound of the general formula (VI), x and y indicate the number of functional groups $F^1$ or $F^2$ present in the molecule. Preference is given to x and y each being, independently of one another, 1, 2 or 3, particularly preferably 1 or 2, very particularly preferably 1.

A very particularly preferred compound of the general formula (VI) is (2-mercapto-phenyl)phosphonic acid.

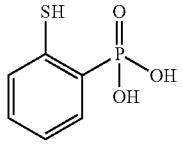

In a preferred embodiment of the process of the invention, the functional group $F^1$ in the compound of the general formula (VI) binds to the at least one magnetic particle and the functional group $F^2$ in the compound of the general formula (VI) binds to the at least one first material.

In further embodiments of the process of the invention, the mixture to be treated can firstly be brought into contact with at least one hydrophobicizing agent so that an adduct of the at least one hydrophobicizing agent and the at least one first material is formed, this adduct is then brought into contact with at least one magnetic particle functionalized on the surface by at least one polymeric compound which has an LCST (Lower Critical Solution Temperature) at a temperature at which the polymeric compound has hydrophobic character, so that the adduct and the at least one functionalized magnetic particle agglomerate or step (A) is carried out by producing a suspension of the mixture comprising at least one first material and at least one second material and at least one magnetic particle in a suitable suspension medium and setting the pH of the resulting suspension to a value at which the at least one first material and the at least one magnetic particle have opposite surface charges, so that they agglomerate.

In all embodiments of step (A) of the process of the invention, an energy input of at least 10 $kW/m^3$, preferably at least 100 $kW/m^3$, particularly preferably at least 1000 $kW/m^3$, is introduced in step (A). The energy introduced in step (A) is not more than 20 000 $kW/m^3$, preferably not more than 10 000 $kW/m^3$.

In a further preferred embodiment of the process of the invention, a shear rate of at least 5000 1/s, preferably at least 10 000 1/s, particularly preferably 20 000 1/s, is present in step (A). The shear rate present in step (A) is not more than 30 000 1/s, particularly preferably not more than 50 000 1/s.

In a very particularly preferred embodiment of the process of the invention, an energy input of at least 10 $kWm^3$, preferably at least 100 $kW/m^3$, particularly preferably at least 1000 $kW/m^3$, is introduced in step (A) and a shear rate of at least 5000 1/s, preferably at least 10 000 1/s, particularly preferably 30 000 1/s, is present in step (A).

It is the high energy input according to the invention which is introduced into the dispersion in step (A), preferably in combination with a high shear rate, which makes it possible for very intensive mixing to be obtained in step (A) in order to bring the at least one first material and the at least one magnetic particle into contact to a sufficient extent and thus couple the corresponding surfaces. Such improved coupling enables the degree of separation achieved in the process of the invention to be increased.

In the process of the invention, in particular step (A), agglomerates of at least one first material and at least one second material can be separated at least briefly during dispersion so that contact between the at least one first material and the at least one magnetic particle is made possible and steric blocking of the at least one first material, for example by the at least one second material, can be eliminated in this way.

The high energy input and the high shear rate which is preferably present according to the invention in step (A) are, according to the invention, achieved by, in particular, in-line dispersers (rotor/stator principle), T-mixers and other high-intensity mixers. In these preferred embodiments, dispersion is effected by high-energy particle-particle impact.

Due to the high energy input according to the invention in step (A), particularly homogeneous mixing of the mixture to be treated is achieved. This enables the efficiency of the process to be increased compared to processes in which agglomerate formation is carried out without input of a high quantity of energy. As a result, the amount of at least one second material in the ore/magnetic particle mixture discharged can be decreased according to the invention, so that during a subsequent work-up of the ore, for example by smelting, less slag is formed, so that the overall space-time yield of the process can be increased.

Step (B):

The optional step (B) of the process of the invention comprises addition of at least one dispersion medium to the mixture obtained in step (A) in order to obtain a diluted dispersion.

The mixture obtained in step (A) comprises, in one embodiment, at least one dispersion medium, agglomerates of at least one first material and at least one magnetic particle, at least one second material and, if appropriate, surface-active substances, polymeric compounds, etc., depending on which embodiment has been carried out in step (A).

Step (B) can be carried out, i.e. further dispersion medium is added, in order to obtain a dispersion having a lower concentration.

Suitable dispersion media are all dispersion media which have been mentioned above with regard to step (A). In a particularly preferred embodiment, the dispersion medium in step (B) is water.

In general, the amount of dispersion medium added in step (A) and optionally in step (B) can, according to the invention, be selected so that a dispersion which is readily stirrable and/or conveyable is obtained. In a preferred embodiment, the amount of mixture to be treated based on the total slurry or dispersion is up to 90% by weight, particularly preferably from 5 to 50% by weight.

In a preferred embodiment of the process of the invention, step (B) is not carried out but instead step (A) is carried out from the beginning in an aqueous dispersion having an appropriate concentration.

The optional addition of dispersion medium in step (B) of the process of the invention can, according to the invention, be carried out by all methods known to those skilled in the art.

Step (C):

Step (C) of the process of the invention comprises separation of the agglomerate from step (A) from the mixture by application of a magnetic field.

In a preferred embodiment, step (C) can be carried out by introducing a permanent magnet into the reactor in which the mixture from step (A) or (B) is present. In a preferred embodiment, a dividing wall composed of nonmagnetic material, for example the glass wall of the reactor, is present between the permanent magnet and the mixture to be treated. In a further preferred embodiment of the process of the invention, an electromagnet which is only magnetic when an electric current flows is used in step (C). Suitable apparatuses are known to those skilled in the art.

Step (C) of the process of the invention can be carried out at any suitable temperature, for example from 10 to 60° C.

During step (C), the mixture is preferably stirred so that the magnetic components to be separated off move to the magnetic field applied.

In step (C), the agglomerate from step (A) or (B) may, if appropriate, be separated off by all methods known to those skilled in the art, for example by draining of the liquid comprising the hydrophilic component of the suspension from the bottom valve of the reactor used for step (C) or pumping away the components of the suspension which have not been held by the at least one magnet through a hose.

Step (D):

Step (D) of the process of the invention comprises dissociation of the agglomerate separated off in step (C) in order to obtain the at least one first material and the at least one magnetic particle separately.

The dissociation method employed in step (D) of the process of the invention is dependent on the method by which the agglomerates have been formed in step (A).

The dissociation can be carried out by all methods known to those skilled in the art which are suitable for dissociating the agglomerate in such a way that the at least one magnetic particle can be recovered in reusable form. In a preferred embodiment, the magnetic particle which has been split off is reused in step (A).

In a preferred embodiment, the dissociation in step (D) of the process of the invention is effected by treating the agglomerate with a substance selected from the group consisting of organic solvents, basic compounds, acidic compounds, oxidants, reducing agents, surface-active compounds and mixtures thereof.

Examples of suitable organic solvents are methanol, ethanol, propanol, for example n-propanol or isopropanol, aromatic solvents, for example benzene, toluene, xylenes, ethers, for example diethyl ether, methyl t-butyl ether, ketones, for example acetone, aromatic or aliphatic hydrocarbons, for example saturated hydrocarbons having, for example, from 8 to 16 carbon atoms, for example dodecane and/or Shellsol®, diesel fuels and mixtures thereof. The main constituents of diesel fuel are alkanes, cycloalkanes and aromatic hydrocarbons having from about 9 to 22 carbon atoms per molecule and a boiling range from 170° C. to 390° C.

Examples of basic compounds which can be used according to the invention are aqueous solutions of basic compounds, for example aqueous solutions of alkali metal and/or alkaline earth metal hydroxides, for example KOH, NaOH, milk of line, aqueous ammonia solutions, aqueous solutions of organic amines of the general formula $R^2{}_3N$, where the radicals $R^2$ are selected independently from the group consisting of $C_1$-$C_8$-alkyl, optionally substituted by further functional groups. In a preferred embodiment, step (D) is carried out by adding aqueous NaOH solution to a pH of 13, for example for separating off $Cu_2S$ modified with OPA. The acidic compounds can be mineral acids, for example HCl, $H_2SO_4$, $HNO_3$ or mixtures thereof, organic acids, for example carboxylic acids. As oxidant, it is possible to use, for example, $H_2O_2$, for example as 30% strength by weight aqueous solution (perhydrol). To separate off $Cu_2S$ modified with thiols, preference is given to using $H_2O_2$ or $Na_2S_2O_4$.

Examples of surface-active compounds which can be used according to the invention are nonionic, anionic, cationic and/or zwitterionic surfactants.

In a preferred embodiment, the agglomerate of hydrophobic material and magnetic particle is dissociated by means of an organic solvent, particularly preferably by means of acetone and/or diesel. This process can also be aided mechanically. In a preferred embodiment, ultrasound is used for aiding the dissociation process.

In general, the organic solvent is used in an amount which is sufficient to dissociate virtually all the agglomerate. In a preferred embodiment, from 5 to 15 ml of the organic solvent are used per gram of agglomerate of hydrophobic material and magnetic particle which is to be dissociated.

According to the invention, the at least one first material and the at least one magnetic particle are present as a dispersion either in said dissociation reagent, preferably an organic solvent, or in water after the dissociation.

The at least one magnetic particle can be separated off from the dispersion comprising this at least one magnetic particle and the at least one first material by means of a permanent magnet or electromagnet. Details of this separation are analogous to step (C) of the process of the invention.

The first material to be separated off, preferably the metal compound to be separated off, is preferably separated from the organic solvent by filtration. The first material which can be obtained in this way can be purified by further processes known to those skilled in the art. The solvent can, if appropriate after purification, be recirculated to the process of the invention. If a dispersion of the at least one first material in water is present after the magnetic particles have been separated off, the water can likewise be removed by methods known to those skilled in the art, for example distillation, filtration, decantation and/or centrifugation.

EXAMPLES

Example 1

A mixture of 735 g of sand and 15 g of $Cu_2S$ ($x_{50}$=18 μm) is made up in 2250 g of water. The mixture is circulated in a bypass to the reservoir (specific energy input by stirring about 7 kW/m$^3$) through an in-line high-intensity mixer (=Ultra-Turrax) having a mixing chamber of 60 ml (rotor/stator principle). The energy introduced is about 9800 kW/m$^3$ at a shear rate of 12 500 1/s.

3.84 g of a 10% strength octylxanthate solution are added and the mixture is stirred and circulated in the bypass for 15 minutes.

5 g of hydrophobicized magnetite is added, the mixture is stirred and circulated in the bypass for 30 minutes.

The mixture which has been pretreated in this way is separated in a continuously operating magnetic separator. The flow rate of the feed stream is 30 l/h. The magnetic components (and the desired product (=$Cu_2S$) attached thereto) are conveyed over moving permanent magnets in a lateral pipe section and discharged in a substream (=concentrate stream) which is carried out at a constant flow rate of about 3 l/h by means of a pump.

86% of the $Cu_2S$ and 95% of the magnetite are recovered in the concentrate stream.

The concentrate is dried to a water content of 21% (e.g. by means of decanter centrifuges). The concentrate which has been dried in this way is subsequently stirred vigorously in 100 ml of Shellsol® for 30 minutes by means of an Ultra-Turrax (9800 kW/m$^3$). The mixture obtained in this way is again subjected to magnetic separation and the magnetic constituents are in this way separated from the nonmagnetic constituents. Drying of the two product streams obtained in this way gives 71% of the $Cu_2S$ in the concentrate fed in the nonmagnetic product stream. The magnetite content is below 0.5% (determined by XRD with EDX combined with elemental analysis for iron and oxygen). 96% of the magnetite in the concentrate is recovered in the magnetic fraction which still comprises 15% of $Cu_2S$. The missing amounts have been taken as samples or remain as sediment in the pipes (=tubing).

Example 2

A mixture of 735 g of sand and 15 g of $Cu_2S$ ($x_{50}$=18 μm) is made up in 2250 g of water. The mixture is stirred in the reservoir. The energy introduced is about 7 kW/m$^3$ at a shear rate of 210 1/s.

0.3 g of dry octylxanthate are added and the mixture is stirred for 15 minutes.

22.5 g of hydrophobicized magnetite are added and the mixture is stirred for 30 minutes.

The mixture which has been pretreated in this way is separated in a continuously operating magnetic separator. The flow rate of the feed stream is 30 l/h. The magnetic components (and the desired product (=$Cu_2S$) attached thereto) are conveyed over moving permanent magnets in a lateral pipe section and discharged in a substream (=concentrate stream) which is carried out at a constant flow rate of about 3 l/h by means of a pump.

33% of the $Cu_2S$ and 97% of the magnetite are recovered in the concentrate stream.

The concentrate mixture obtained in this way is treated as in example 1.

Example 3

A mixture of 735 g of sand and 15 g of $Cu_2S$ ($x_{50}$=34 μm) is made up in 2250 g of water. The mixture is circulated in a bypass to the reservoir (specific energy input by stirring about 7 kW/m$^3$) through an in-line high-intensity mixer (=Turrax) having a mixing chamber of 60 ml (rotor/stator principle). The energy introduced is about 9800 kW/m$^3$ at a shear rate of 12 500 1/s.

0.3 g of dry octylxanthate are added, the mixture is stirred and circulated in the bypass for 15 minutes.

22.5 g of hydrophobicized magnetite are added, the mixture is stirred and circulated in the bypass for 30 minutes.

The mixture which has been pretreated in this way is separated in a continuously operating magnetic separator. The flow rate of the feed stream is 30 l/h. The magnetic components (and the desired product (=$Cu_2S$) attached thereto) are conveyed over moving permanent magnets in a lateral pipe section and discharged in a substream (=concentrate stream) which is carried out at a constant flow rate of about 3 l/h by means of a pump.

97% of the $Cu_2S$ and 100% of the magnetite are recovered in the concentrate stream.

The concentrate mixture obtained in this way is treated as in example 1.

Example 4

A mixture of 735 g of sand and 15 g of $Cu_2S$ ($x_{50}$=34 μm) is made up in 2250 g of water. The mixture is stirred in the reservoir. The energy introduced is about 7 kW/m$^3$ at a shear rate of 210 1/s.

0.3 g of dry octylxanthate are added and the mixture is stirred for 15 minutes.

22.5 g of hydrophobicized magnetite are added and the mixture is stirred for 30 minutes.

The mixture which has been pretreated in this way is separated in a continuously operating magnetic separator. The flow rate of the feed stream is 30 l/h. The magnetic components (and the desired product (=$Cu_2S$) attached thereto) are conveyed over moving permanent magnets in a lateral pipe section and discharged in a substream (=concentrate stream) which is carried out at a constant flow rate of about 3 l/h by means of a pump.

84% of the $Cu_2S$ and 94% of the magnetite are recovered in the concentrate stream.

The concentrate mixture obtained in this way is treated as in example 1.

The results of examples 1 to 4 are shown in table 1.

TABLE 1

| | Example 1 | Example 2 | Example 3 | Example 4 |
|---|---|---|---|---|
| Amount of sand [g] | 735 | 735 | 735 | 735 |
| Amount of $Cu_2S$ [g] | 15 | 15 | 15 | 15 |
| Particle size $x_{50}$ of $Cu_2S$ [μm] | 18 | 18 | 34 | 34 |

TABLE 1-continued

| | Example 1 | Example 2 | Example 3 | Example 4 |
|---|---|---|---|---|
| Amount of octylxanthate [g] | 3.84 | 0.3 | 0.3 | 0.3 |
| Concentration of octylxanthate [% by wt.] | 10 | 100 | 100 | 100 |
| Specific energy [kW/m$^3$] | 9800 | 7 | 9800 | 7 |
| Shear rate [1/s] | 12500 | 210 | 12500 | 120 |
| Flow rate of feed stream [l/h] | 30 | 30 | 30 | 30 |
| Flow rate of concentrate stream [l/h] | 3 | 3 | 3 | 3 |
| Cu recovery [%] | 86 | 33 | 97 | 84 |
| Fe recovery [%] | 95 | 97 | 100 | 94 |

The invention claimed is:

1. A process for separating a material from a mixture, the process comprising:

(A) contacting a mixture comprising a first material and a second material with a magnetic particle in the presence of a dispersion medium, thereby agglomerating the first material and the magnetic particle and obtaining a dispersion;

(B) optionally, adding a second dispersion medium to the dispersion obtained in (A);

(C) separating the agglomerate from (A) or (B) from the dispersion by applying a magnetic field; and (D) dissociating the agglomerate from (C), to obtain the first material and the magnetic particle separately, wherein:

an energy input of at least 10 kW/m$^3$ is introduced into the dispersion in (A);

the first material is coal or at least one hydrophobic metal compound selected from the group consisting of a sulfidic ore, an oxidic-comprising ore, and a carbonate-comprising ore; and the second material is a hydrophilic metal compound selected from the group consisting of an oxidic and a hydroxidic metal compound.

2. The process of claim 1, wherein a shear rate of at least 5000 1/s is present in (A).

3. The process of claim 1, wherein the magnetic particle is at least one selected from the group consisting of:

a magnetic metal and mixtures thereof;

a ferromagnetic alloy comprising a magnetic metal and mixtures thereof;

a magnetic iron oxide;

a cubic ferrite of formula (II):

$$M^{2+}_{x}Fe^{2+}_{1-x}Fe^{3+}_{2}O_4 \quad \text{(II)}$$

wherein M is selected from the group consisting of Co, Ni, Mn, Zn, and mixtures thereof and $x \leqq 1$; and a hexagonal ferrite and mixtures thereof.

4. The process of claim 1, wherein the dispersion medium is water.

5. The process of claim 1, wherein the first material and the magnetic particle agglomerate by at least one selected from the group consisting of hydrophobic interactions, different surface charges, and compounds present in the mixture which selectively couple the first material and the magnetic particle.

6. The process of claim 1, further comprising, prior to or during (A):

milling the mixture comprising the first material and the second material, to obtain particles having a size of from 100 nm to 100 μm.

7. The process of claim 1, wherein the first material is coal.

8. The process of claim 1, wherein the first material is a sulfidic ore.

9. The process of claim 1, wherein the first material is an oxidic-comprising ore.

10. The process of claim 1, wherein the first material is a carbonate-comprising ore.

11. The process of claim 1, wherein the second material is an oxidic metal compound.

12. The process of claim 1, wherein the second material is a hydroxidic metal compound.

13. The process of claim 1, wherein the magnetic particle is at least one magnetic metal selected from the group consisting of iron, cobalt, and nickel.

14. The process of claim 1, wherein the magnetic particle is a ferromagnetic alloy comprising at least one magnetic metal selected from the group consisting of iron, cobalt, and nickel.

15. The process of claim 1, wherein the magnetic particle is a magnetic iron oxide selected from the group consisting of magnetite and maghemite.

16. The process of claim 15, wherein the magnetic particle is magnetite.

17. The process of claim 1, wherein the magnetic particle is a cubic ferrite of formula (II) and mixtures thereof:

$$M^{2+}_{x}Fe^{2+}_{1-x}Fe^{3+}_{2}O_4 \quad \text{(II)}$$

wherein

M is independently selected from the group consisting of Co, Ni, Mn, and Zn; and $x \leqq 1$.

18. The process of claim 17, wherein, in formula (II), M is Co.

19. The process of claim 1, wherein the magnetic particle is a hexagonal ferrite of formula (III) and mixtures thereof:

$$MFe_{12}O_{19} \quad \text{(III)},$$

wherein M is independently selected from the group consisting of Ca, Sr, and Ba.

* * * * *

UNITED STATES PATENT AND TRADEMARK OFFICE

CERTIFICATE OF CORRECTION

PATENT NO. : 8,486,270 B2
APPLICATION NO. : 13/509413
DATED : July 16, 2013
INVENTOR(S) : Reinhold Rieger et al.

It is certified that error appears in the above-identified patent and that said Letters Patent is hereby corrected as shown below:

On the title page, Item (73), the 2nd Assignee's Information and Item (30), the Foreign Application Priority Data are incorrect. Items (73) and (30) should read:

--(73) Assignees: BASF SE, Ludwigshafen (DE); Siemens Aktiengesellschaft, Muenchen, (DE)

(30) Foreign Application Priority Data

Nov. 11, 2009 (EP) .....09175635.3--

Signed and Sealed this
Twenty-fourth Day of September, 2013

Teresa Stanek Rea
*Deputy Director of the United States Patent and Trademark Office*